US007508314B2

(12) United States Patent
Andres et al.

(10) Patent No.: US 7,508,314 B2
(45) Date of Patent: Mar. 24, 2009

(54) LOW BATTERY WARNING SILENCING IN LIFE SAFETY DEVICES

(75) Inventors: John J. Andres, Chapel Hill, NC (US); Matthew J. Buchholz, Canon City, CO (US); Stan Burnette, Colorado Springs, CO (US); Travis Silver, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 0 days.

(21) Appl. No.: 11/253,074

(22) Filed: Oct. 17, 2005

(65) Prior Publication Data

US 2006/0082464 A1 Apr. 20, 2006

Related U.S. Application Data

(60) Provisional application No. 60/620,225, filed on Oct. 18, 2004.

(51) Int. Cl.
*G08B 21/00* (2006.01)

(52) U.S. Cl. ..... 340/636.19; 340/635; 340/660

(58) Field of Classification Search ..... 340/660
See application file for complete search history.

(56) References Cited

U.S. PATENT DOCUMENTS

| | | | |
|---|---|---|---|
| 2,249,560 | A | 7/1941 | Howton |
| 2,566,121 | A | 8/1951 | Decker |
| 3,559,194 | A | 1/1971 | Bisberg |
| 3,909,826 | A | 9/1975 | Schildmeier et al. |
| 3,932,850 | A | 1/1976 | Conforti et al. |
| 4,020,479 | A | 4/1977 | Conforti et al. |
| 4,091,363 | A | 5/1978 | Siegel et al. |
| 4,097,851 | A | 6/1978 | Klein |
| 4,112,310 | A | 9/1978 | Malinowski |
| 4,138,664 | A | 2/1979 | Conforti et al. |
| 4,138,670 | A | 2/1979 | Schneider et al. |
| 4,139,846 | A | 2/1979 | Conforti |
| 4,160,246 | A | 7/1979 | Martin et al. |
| 4,178,592 | A | 12/1979 | McKee |
| 4,189,720 | A | 2/1980 | Lott |
| 4,204,201 | A | 5/1980 | Williams et al. |
| 4,225,860 | A | 9/1980 | Conforti |

(Continued)

FOREIGN PATENT DOCUMENTS

| | | |
|---|---|---|
| EP | 1 213 692 A2 | 6/2002 |

(Continued)

OTHER PUBLICATIONS

Invensys Climate ControlsInensys Launch Firex® 7000 Combination Smoke and Carbon Monoxide Alarm, 2 pages (Oct. 16, 2003).

(Continued)

*Primary Examiner*—George A Bugg
(74) *Attorney, Agent, or Firm*—Merchant & Gould P.C.

(57) ABSTRACT

A life safety device can include a battery monitoring module configured to measure a voltage level of a battery, an alarm module configured to provide an alarm when the voltage level is less than or equal to a low battery threshold, and a silence module configured to silence the alarm for a random time period.

20 Claims, 3 Drawing Sheets

U.S. PATENT DOCUMENTS

| | | | | |
|---|---|---|---|---|
| 4,232,308 | A | | 11/1980 | Lee et al. |
| 4,258,261 | A | | 3/1981 | Conforti |
| 4,284,849 | A | | 8/1981 | Anderson et al. |
| 4,287,517 | A | | 9/1981 | Nagel |
| 4,302,753 | A | | 11/1981 | Conforti |
| 4,363,031 | A | | 12/1982 | Reinowitz |
| 4,517,555 | A | | 5/1985 | Marsocci et al. |
| 4,531,114 | A | | 7/1985 | Topol et al. |
| 4,556,873 | A | | 12/1985 | Yamada et al. |
| 4,581,606 | A | | 4/1986 | Mallory |
| 4,583,072 | A | | 4/1986 | Matsushita |
| 4,594,581 | A | | 6/1986 | Matoba |
| 4,647,219 | A | | 3/1987 | Figler et al. |
| 4,692,750 | A | | 9/1987 | Murakami et al. |
| 4,737,770 | A | | 4/1988 | Brunius et al. |
| 4,772,876 | A | | 9/1988 | Laud |
| 4,788,530 | A | | 11/1988 | Bernier |
| 4,801,924 | A | | 1/1989 | Burgmann et al. |
| 4,814,748 | A | | 3/1989 | Todd |
| 4,827,244 | A | | 5/1989 | Bellavia et al. |
| 4,829,283 | A | | 5/1989 | Spang et al. |
| 4,845,474 | A | | 7/1989 | Moore et al. |
| 4,855,713 | A | | 8/1989 | Brunius |
| 4,859,990 | A | | 8/1989 | Isaacman |
| 4,870,395 | A | | 9/1989 | Belano |
| 4,884,065 | A | | 11/1989 | Crouse et al. |
| 4,901,056 | A | | 2/1990 | Bellavia et al. |
| 4,904,988 | A | | 2/1990 | Nesbit et al. |
| 4,951,029 | A | | 8/1990 | Severson |
| 4,965,556 | A | | 10/1990 | Brodecki et al. |
| 4,992,965 | A | | 2/1991 | Hölter et al. |
| 5,034,725 | A | | 7/1991 | Sorensen |
| 5,063,164 | A | | 11/1991 | Goldstein |
| 5,066,466 | A | | 11/1991 | Hölter et al. |
| 5,077,547 | A | | 12/1991 | Burgmann |
| 5,095,300 | A | | 3/1992 | Alexander et al. |
| 5,103,216 | A | | 4/1992 | Sisselman |
| RE33,920 | E | | 5/1992 | Tanguay et al. |
| 5,122,782 | A | | 6/1992 | Kawahara |
| 5,132,958 | A | | 7/1992 | Camps et al. |
| 5,132,968 | A | | 7/1992 | Cephus |
| 5,159,315 | A | | 10/1992 | Schultz et al. |
| 5,172,096 | A | | 12/1992 | Tice et al. |
| 5,177,461 | A | | 1/1993 | Budzyna et al. |
| 5,252,949 | A | | 10/1993 | Kirby et al. |
| 5,280,273 | A | | 1/1994 | Goldstein |
| 5,285,792 | A | | 2/1994 | Sjoquist et al. |
| 5,289,165 | A | | 2/1994 | Belin |
| 5,317,305 | A | | 5/1994 | Campman |
| 5,386,209 | A | | 1/1995 | Thomas |
| 5,408,217 | A | | 4/1995 | Sanderford, Jr. |
| 5,422,629 | A | | 6/1995 | Minnis |
| 5,440,293 | A | | 8/1995 | Tice |
| 5,442,336 | A | | 8/1995 | Murphy et al. |
| 5,444,434 | A | | 8/1995 | Serby |
| 5,473,167 | A | | 12/1995 | Minnis |
| 5,481,259 | A | | 1/1996 | Bane |
| 5,483,222 | A | | 1/1996 | Tice |
| 5,500,639 | A | | 3/1996 | Walley et al. |
| 5,517,182 | A | | 5/1996 | Yasunaga |
| 5,574,436 | A | | 11/1996 | Sisselman et al. |
| 5,578,996 | A | | 11/1996 | Watson et al. |
| 5,587,705 | A | | 12/1996 | Morris |
| 5,594,410 | A | | 1/1997 | Lucas et al. |
| 5,594,422 | A | | 1/1997 | Huey, Jr. et al. |
| 5,621,394 | A | | 4/1997 | Garrick et al. |
| 5,663,714 | A | | 9/1997 | Fray |
| 5,666,331 | A | | 9/1997 | Kollin |
| 5,682,145 | A | | 10/1997 | Sweetman et al. |
| 5,686,885 | A | | 11/1997 | Bergman |
| 5,686,896 | A | | 11/1997 | Bergman |
| 5,694,118 | A | | 12/1997 | Park et al. |
| 5,705,979 | A | | 1/1998 | Fierro et al. |
| 5,748,079 | A | | 5/1998 | Addy |
| 5,764,150 | A | | 6/1998 | Fleury et al. |
| 5,774,038 | A | | 6/1998 | Welch et al. |
| 5,781,143 | A | | 7/1998 | Rossin |
| 5,786,768 | A | | 7/1998 | Chan et al. |
| 5,793,296 | A | | 8/1998 | Lewkowicz |
| 5,801,633 | A | | 9/1998 | Soni |
| 5,808,551 | A | | 9/1998 | Yarnall, Jr. et al. |
| 5,812,617 | A | | 9/1998 | Heckman et al. |
| 5,815,066 | A | | 9/1998 | Pumilia |
| 5,815,075 | A | | 9/1998 | Lewiner et al. |
| 5,818,334 | A | | 10/1998 | Stanley |
| 5,831,526 | A | | 11/1998 | Hansler et al. |
| 5,848,062 | A | | 12/1998 | Ohno |
| 5,857,146 | A | | 1/1999 | Kido |
| 5,867,105 | A | | 2/1999 | Hajel |
| 5,889,468 | A | | 3/1999 | Banga |
| 5,898,369 | A | | 4/1999 | Goodwin |
| 5,905,438 | A | | 5/1999 | Weiss et al. |
| 5,907,279 | A | | 5/1999 | Bruins et al. |
| 5,914,656 | A | | 6/1999 | Ojala et al. |
| 5,949,332 | A | | 9/1999 | Kim |
| 5,966,078 | A | * | 10/1999 | Tanguay ..... 340/636.1 |
| 5,969,600 | A | * | 10/1999 | Tanguay ..... 340/438 |
| 5,977,871 | A | | 11/1999 | Miller et al. |
| 6,028,513 | A | | 2/2000 | Addy |
| 6,044,359 | A | | 3/2000 | Goodwin, III |
| 6,049,273 | A | | 4/2000 | Hess |
| 6,054,920 | A | | 4/2000 | Smith et al. |
| 6,078,269 | A | | 6/2000 | Markwell et al. |
| 6,081,197 | A | | 6/2000 | Garrick et al. |
| 6,084,522 | A | | 7/2000 | Addy |
| 6,111,872 | A | | 8/2000 | Suematsu et al. |
| 6,114,955 | A | | 9/2000 | Brunius et al. |
| 6,133,839 | A | | 10/2000 | Ellul, Jr. et al. |
| 6,144,289 | A | | 11/2000 | Le Bel |
| 6,144,310 | A | | 11/2000 | Morris |
| 6,150,936 | A | | 11/2000 | Addy |
| 6,172,612 | B1 | | 1/2001 | Odachowski |
| 6,188,715 | B1 | | 2/2001 | Partyka |
| 6,208,253 | B1 | | 3/2001 | Fletcher et al. |
| 6,229,449 | B1 | | 5/2001 | Kirchner et al. |
| 6,243,010 | B1 | | 6/2001 | Addy et al. |
| 6,292,108 | B1 | | 9/2001 | Straser et al. |
| 6,301,514 | B1 | | 10/2001 | Canada et al. |
| 6,307,482 | B1 | | 10/2001 | Le Bel |
| 6,323,780 | B1 | | 11/2001 | Morris |
| 6,353,395 | B1 | | 3/2002 | Duran |
| 6,380,860 | B1 | | 4/2002 | Goetz |
| 6,384,724 | B1 | | 5/2002 | Landais |
| 6,414,599 | B1 | | 7/2002 | Hsieh |
| 6,420,973 | B2 | | 7/2002 | Acevedo |
| 6,441,723 | B1 | | 8/2002 | Mansfield, Jr. et al. |
| 6,445,291 | B2 | | 9/2002 | Addy et al. |
| 6,445,292 | B1 | | 9/2002 | Jen et al. |
| 6,492,907 | B1 | | 12/2002 | McCracken |
| 6,529,128 | B2 | | 3/2003 | Weng |
| 6,577,242 | B2 | | 6/2003 | Jen et al. |
| 6,600,424 | B1 | | 7/2003 | Morris |
| 6,611,204 | B2 | | 8/2003 | Schmurr |
| 6,624,750 | B1 | | 9/2003 | Marman et al. |
| 6,624,760 | B1 | | 9/2003 | Kinzel et al. |
| 6,642,849 | B1 | | 11/2003 | Kondziolka |
| 6,693,532 | B2 | | 2/2004 | Capowski et al. |
| 6,762,688 | B2 | | 7/2004 | Johnston et al. |
| 6,791,453 | B1 | | 9/2004 | Andres et al. |
| 6,819,252 | B2 | * | 11/2004 | Johnston et al. ..... 340/630 |
| 2001/0024163 | A1 | | 9/2001 | Petite |
| 2001/0038336 | A1 | | 11/2001 | Acevedo |
| 2001/0038337 | A1 | | 11/2001 | Wickstead et al. |
| 2001/0043144 | A1 | | 11/2001 | Morris |

| | | | |
|---|---|---|---|
| 2002/0021223 | A1 | 2/2002 | Jen et al. |
| 2002/0044061 | A1* | 4/2002 | Johnston et al. ..... 340/628 |
| 2002/0047774 | A1 | 4/2002 | Christensen et al. |
| 2002/0080039 | A1 | 6/2002 | Vining |
| 2002/0093430 | A1 | 7/2002 | Goodwin |
| 2002/0093439 | A1 | 7/2002 | Lundin et al. |
| 2002/0126016 | A1 | 9/2002 | Sipp |
| 2002/0130782 | A1 | 9/2002 | Johnston et al. |
| 2002/0145513 | A1 | 10/2002 | Ropke |
| 2002/0158764 | A1 | 10/2002 | Conway |
| 2002/0163428 | A1 | 11/2002 | Weng |
| 2002/0175811 | A1 | 11/2002 | Merrell et al. |
| 2003/0031140 | A1 | 2/2003 | Oprescu-Surcobe et al. |
| 2003/0052770 | A1 | 3/2003 | Mansfield, Jr. et al. |
| 2003/0058114 | A1 | 3/2003 | Miller et al. |
| 2003/0080865 | A1 | 5/2003 | Capowski et al. |
| 2003/0090375 | A1 | 5/2003 | Addy et al. |
| 2003/0179096 | A1 | 9/2003 | Hanan |
| 2003/0210138 | A1 | 11/2003 | Farley |
| 2003/0227387 | A1 | 12/2003 | Kimberlain et al. |
| 2003/0230415 | A1 | 12/2003 | Wilson et al. |

FOREIGN PATENT DOCUMENTS

| | | | |
|---|---|---|---|
| JP | 2-121093 | | 5/1990 |
| JP | 3-30096 | | 2/1991 |
| JP | 3-240198 | | 10/1991 |
| JP | 3-276393 | | 12/1991 |
| JP | 4-10194 | | 1/1992 |
| JP | 4-57197 | A | 2/1992 |
| JP | 5-210790 | | 8/1993 |
| JP | 7-6283 | | 1/1995 |
| JP | 7-65268 | | 3/1995 |
| JP | 8-751 | | 1/1996 |
| JP | 10-11680 | | 1/1998 |
| JP | 11-86160 | | 3/1999 |
| JP | 2002-216261 | | 8/2002 |
| JP | 2002-216262 | | 8/2002 |
| WO | WO 92/10820 | | 6/1992 |
| WO | WO 94/03881 | | 2/1994 |
| WO | WO 02/084620 | A1 | 10/2002 |

OTHER PUBLICATIONS

AICO, Radiolink, 6 pages (Sep. 23, 2004).
Supplmentary European Search Report mailed Oct. 21, 2008.

* cited by examiner

LOW BATTERY WARNING SILENCING IN LIFE SAFETY DEVICES

RELATED APPLICATION

This application claims the benefit of U.S. Patent Provisional Application Ser. No. 60/620,225 filed on Oct. 18, 2004, the entirety of which is hereby incorporated by reference.

TECHNICAL FIELD

The disclosed technology relates to life safety devices. More particularly, the disclosed technology relates to life safety devices that operate on battery power.

BACKGROUND

It is known to use life safety devices within a building or other structure to detect various hazardous conditions and provide a warning to occupants of the building of the detected hazardous condition. Examples of well known life safety devices include smoke detectors and carbon monoxide detectors.

Due to the critical function of life safety devices, the devices are often battery powered, or are AC powered with one or more backup batteries, to prevent the devices from being disabled in the event of an AC power failure. As the level of the battery tends to decrease over time, life safety devices are typically provided with a battery voltage test circuit that periodically tests the battery level of the detector. When the battery voltage drops below a predetermined level at which it is determined that the battery should be replaced, a warning is triggered to advise the occupant of the building in which the device is installed that the battery needs replacement. The warning is usually an audible warning and/or a visual warning.

Despite the apparent safety value in providing a low battery warning, such warnings are sometimes a nuisance, particularly when the warning occurs at night while a person is trying to sleep. To eliminate the warning, some users resort to removing the battery. However, removing the battery is undesirable as it prevents operation of the life safety device so that the device no longer functions as intended.

For safety reasons, safety regulations do not permit the low battery warning to be permanently silenced. However, the use of life safety devices provided with the capability of temporarily silencing low battery warnings are known. Examples of devices that indicate a low battery and/or permit a user to temporarily silence a low battery warning includes U.S. Pat. Nos. 6,624,750, 6,081,197, 5,969,600, 5,686,885, 5,686,896, 4,287,517 and U.S. Patent Published Application Nos. 2003/0227387 and 2002/0130782.

For life safety devices that permit temporary silencing of a low battery warning, the low battery warning is silenced for a predetermined period of time. However, silencing the warning for a predetermined period of time presents various problems. For example, a user who silences the low battery warning knowing that it will be silenced for a predetermined period of time can procrastinate in replacing the battery for sake of convenience or to get the most life out of the battery. When the low battery warning sounds, the user may silence the warning and, knowing that the silence period will end after a predetermined time period, make it a point to return to silence the warning once again just prior to the end of the time period. The user may continue to do this for as long as possible, maximizing the use of the battery, until the battery level reaches a voltage threshold at which the user is no longer able to silence the warning.

Thus, there is a continuing need for improvements in life safety devices having silenceable low battery alarms.

SUMMARY

The disclosed technology relates to life safety devices. More particularly, the disclosed technology relates to life safety devices that operate on battery power.

According to one aspect, a life safety device includes a battery monitoring module configured to measure a voltage level of a battery. The device can include an alarm module configured to provide an alarm when the voltage level is less than or equal to a low battery threshold. The device can also include a silence module configured to silence the alarm for a random time period.

According to another aspect, a method of monitoring a voltage level of a battery in a life safety device can include: periodically measuring the voltage level of the battery; providing an audible low battery warning when the voltage level of the battery generally equals or is less than a low battery threshold; and silencing the audible low battery warning for a random time period when the voltage level of the battery is determined to be generally equal to or less than the low battery threshold.

According to yet another aspect, a method of monitoring a voltage level of a battery in a life safety device can include: periodically measuring the voltage level of the battery; entering a low battery mode when the voltage level of the battery generally equals or is less than a low battery threshold, wherein the low battery mode includes providing an audible low battery warning; and entering a low battery silence mode by silencing the audible low battery warning for a random time period when the voltage level of the battery is determined to generally equal to or less than the low battery threshold.

DETAILED DESCRIPTION

Figure 1:
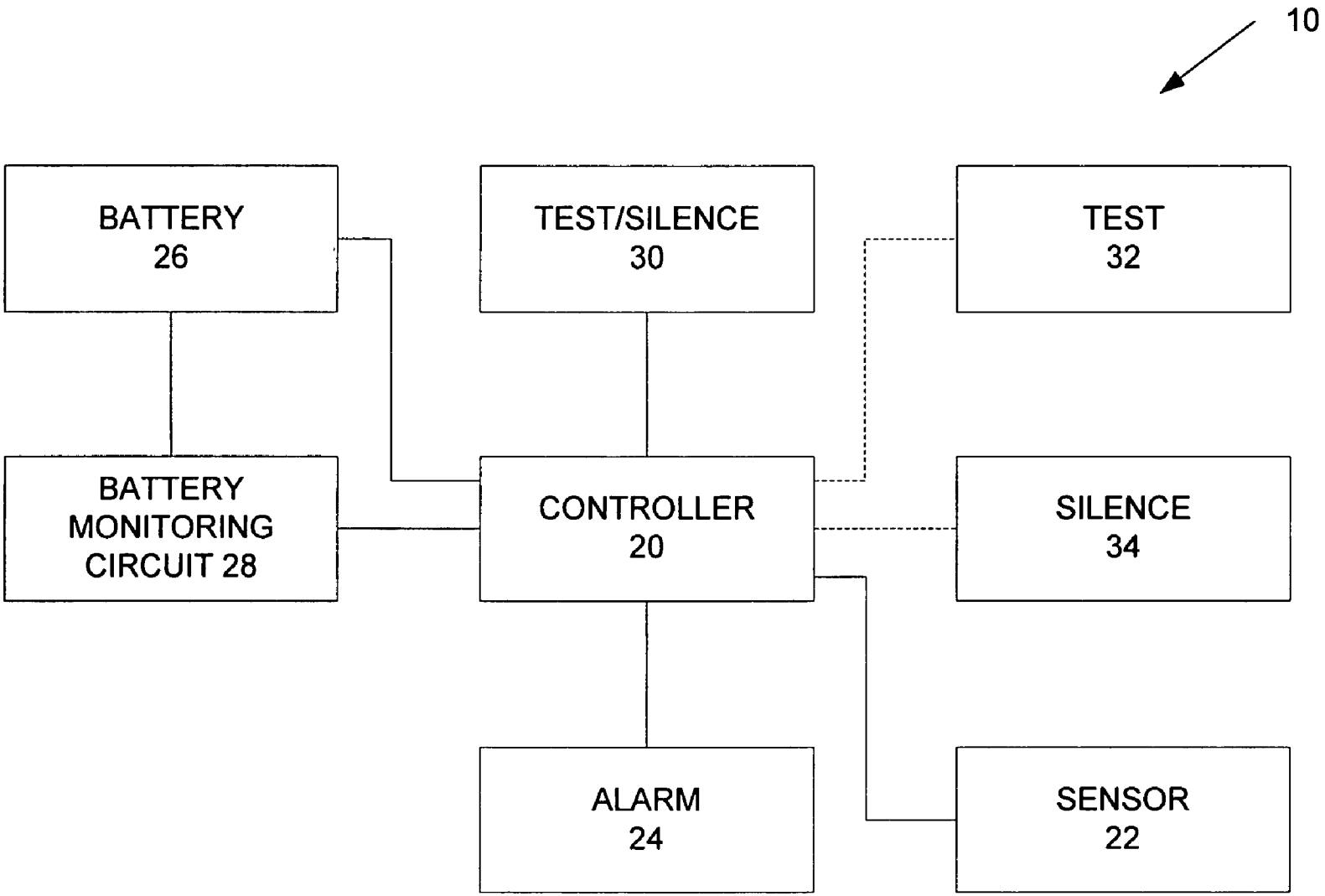
FIG. 1 is a block diagram of an example life safety device.
Figure 2:
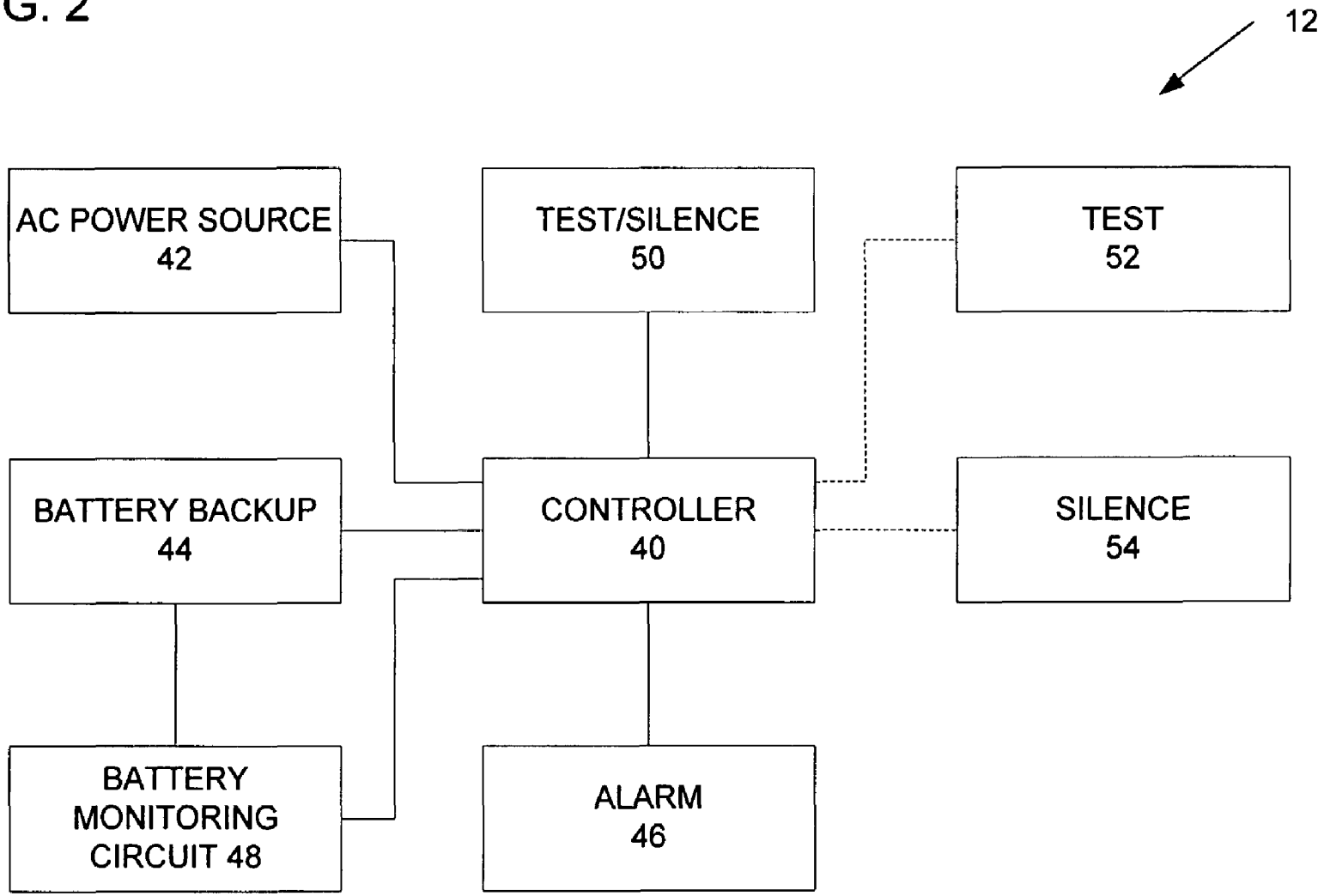
FIG. 2 is a block diagram of another example life safety device.

FIGS. 1 and 2 illustrate embodiments of life safety devices incorporating an example low battery silencing scheme. In FIG. 1, the life safety device is a hazardous condition detector 10, while the life safety device in FIG. 2 is a non-detecting device 12.

The detector 10 and non-detecting device 12 can be used separately, or together in a system of life safety devices as further described in U.S. Patent Provisional Application Ser. No. 60/620,227 filed on Oct. 18, 2004, and U.S. Patent Provisional Application Ser. No. 60/623,978 filed on Nov. 1, 2004, the entireties of which are hereby incorporated by reference.

In use, the hazardous condition detector 10 is located at a suitable location within a building for detecting a hazardous condition at that location. The non-detecting device 12 can be located at any convenient location within the building such as, for example in the room in which the detector 10 is located, or at any location of the building found to be convenient by the building owner.

The hazardous condition detector 10 can include, but is not limited to, a smoke detector, a gas detector for detecting carbon monoxide gas, natural gas, propane, and other toxic gas, a fire detector, flame detector, heat detector, infra-red sensor, ultra-violet sensor, other detectors of hazardous conditions, and combinations thereof. The hazardous condition detector can also include, but is not limited to, a detector that detects a non-environmental hazardous condition, for example a glass breakage sensor and a motion sensor. For sake of convenience, the hazardous condition detector 10 will hereinafter be described and referred to as a smoke detector 10 that is configured to detect smoke. However, it is to be realized that the detector can include other forms of detectors as well.

The smoke detector 10 is preferably configured to be able to produce an alarm when smoke is detected or for testing of the detector 10. The smoke detector 10 can be DC powered by one or more batteries, or AC powered with battery backup. For sake of convenience, the smoke detector 10 will be hereinafter described as being DC powered by one or more batteries.

The non-detecting device 12 is not configured to detect a hazardous condition. Instead, the non-detecting device 12 is intended to communicate with the smoke detector 10 to signal an alarm when the detector 10 detects smoke. The non-detecting device 12 includes, but is not limited to, a sound module for producing an audible alarm, a light unit that is configured to illuminate a light as a warning, a control unit that is configured to store and/or display data received from or relating to other life safety devices in the system, and combinations thereof.

For sake of convenience, the non-detecting device 12 will hereinafter be referred to as a sound module 12 that is configured to produce an audible alarm. The non-detecting device 12 is preferably AC powered with battery backup.

In each of the smoke detector 10 and the non-detecting device 12, the battery power level is periodically checked to ensure that the battery has sufficient power to operate the detector 10 (and the non-detecting device 12 in the event of an AC power failure). If the battery power falls below a predetermined level, a low battery warning is issued to alert the user that the battery needs replacement.

Details of the smoke detector 10 are illustrated in FIG. 1. The smoke detector 10 includes a controller 20 that is preferably a microprocessor. The controller 20 is responsible for all operations of the detector 10. A suitable smoke sensor 22 is connected to the controller 20 for detecting smoke and providing a signal relating to the level of smoke detected. The sensor 22 can be, for example, an ionization smoke sensor or a photoelectric smoke sensor of a type known in the art. Upon a sufficient level of smoke being sensed by sensor 22, the controller 20 sends a signal to an alarm circuit 24 to trigger an audible alarm. Power for the controller 20, the sensor 22, the alarm circuit 24 and the other components of the detector 10 is provided by a battery power source 26.

A battery monitoring circuit 28 periodically measures the battery voltage of the battery 26. For example, the circuit 28 can measure the battery voltage every minute. Battery monitoring circuits are well known in the art, one example of which is disclosed in U.S. Pat. No. 4,972,181. When the circuit 28 detects that the battery 26 falls below a low battery threshold (Vlb), the circuit 28 sends a low battery signal to the controller 20 which places the detector 10 in a low battery mode in which the alarm circuitry 24 sounds a warning to alert the user that the battery 26 should be replaced.

The detector 10 also includes a test/silence button 30. The button 30, when pressed, allows a user to initiate a test of the detector 10 to trigger an alarm on the alarm circuit 24 and silence a local alarm. In addition, the low battery warning can also be silenced by pressing the button 30. In an alternative configuration, illustrated in dashed lines in FIG. 1, separate test 32 and silence 34 buttons can be used instead of the single button 30, where the silence button 34 would be used to silence a low battery warning.

Turning now to FIG. 2, the details of the sound module 12 will now be described. As with the smoke detector 10, the sound module 12 comprises a controller 40, for example at least one microprocessor, for controlling operation of the sound module. The sound module 12 can include two microprocessors, one for controlling communications with the smoke detector 10, and one controller for controlling the other functions of the detector, as described in U.S. Patent Provisional Application Ser. No. 60/620,227 filed on Oct. 18, 2004, and U.S. Patent Provisional Application Ser. No. 60/623,978 filed on Nov. 1, 2004.

The controller 40 and the other components of the sound module 12 are preferably powered by an AC power source 42, such as mains electrical power. In the preferred embodiment, the sound module 12 is configured to plug into an electrical outlet near where it is placed. The sound module 12 also preferably includes one or more batteries 44 as a backup power source.

The sound module 12 does not include a sensor for detecting hazardous conditions, but is in communication with the detector 10 (or with other detectors) to be able to receive a signal from the detector 10 when the detector detects a hazardous condition. Upon a sufficient level of smoke being sensed by the detector 10, the detector 10 sends a signal to the sound module 12, which receives the signal and the controller 40 sends a signal to an alarm circuit 46 to trigger an audible alarm from the sound module 12. Examples regarding how the sound module 12 and detector 10 can communicate are described in U.S. Patent Provisional Application Ser. No. 60/620,227 filed on Oct. 18, 2004, and U.S. Patent Provisional Application Ser. No. 60/623,978 filed on Nov. 1, 2004.

A battery monitoring circuit 48 periodically measures the battery voltage of the backup battery 44. For example, the circuit 48, which can be identical to the circuit 28 used in the detector 10, can measure the battery voltage every minute. Battery monitoring circuits are well known in the art, one example of which is disclosed in U.S. Pat. No. 4,972,181. When the circuit 48 detects that the battery 44 falls below a low battery threshold (Vlb), the circuit 48 sends a low battery signal to the controller 40 which places the sound module 12 in a low battery mode in which the alarm circuitry 46 sounds a warning to alert the user that the battery 44 should be replaced. The controller 40 also detects a voltage silence threshold, Vs, which, when reached, prevents the user from silencing the low battery warning.

The sound module 12 also includes a test/silence button 50. The button 50, when pressed, allows a user to initiate a test of the sound module 12 to trigger an alarm on the alarm circuit 46 and silence a local alarm. In addition, the low battery warning can also be silenced by pressing the button 50. In an alternative configuration, illustrated in dashed lines in FIG. 2, separate test 52 and silence 54 buttons can be used instead of the single button 50, where the silence button 54 would be used to silence a low battery warning.

Low Battery Warning Silencing

As mentioned above, the detector 10 and sound module 12 measure the battery voltage on a periodic basis. When the battery voltage falls below the low battery threshold (Vlb), the detector 10 or sound module 12 will enter a low battery mode in which a low battery warning is emitted by the alarm circuit 24 or 46 to alert the user that the battery 26 or 44 should be replaced. When the user presses the test/silence button 30 or 50, if the device is not currently signaling the detection of a hazardous condition or in a test mode, the device will enter a low battery silence mode. The device 10, 12 will then determine the time that it will remain in the low battery silence mode according to the examples discussed below.

Low Battery Silence Time Determination

Within each controller 20, 40 are various registers, for example 8-bit registers, that contain data used in the operation of the program determining the operation of the device 10, 12. One of the registers, which is referred to as Timer0, increments in value as each instruction in the program operation is executed, starting at zero and continuing to 255 whereupon it returns to zero and repeats incrementing. As the microcontroller 20, 40 executes a large number of instructions per second, for example one million instructions per second, it is impossible to know what the value of Timer0 will be when the test/silence button 30, 50 is pressed. When the sound module 12 uses two microprocessors, each processor can include a register Timer0. In example shown, only the value from the register of one microprocessor is used as described below. In alternative embodiments, the value from the register of either microprocessor can be used.

Sound Module 12

With respect to the sound module 12, when the low battery mode exists and the user wishes to silence the low battery warning and enter the low battery silence mode, the test/silence button 50 is pressed.

The firmware will then measure the battery voltage and classify the voltage in one of four levels called silence levels as set forth in the table below. The table is based on the battery 44 being a 9 volt battery, and Vlb is considered to be 7.5 V. A silence threshold, Vs, for example 7.2 V, is also provided, at and below which the user is not permitted to silence the low battery warning. The silence threshold Vs is considered the battery voltage at which the user should take immediate steps to replace the battery.

Low Battery Silence Level Determination

| Vbat | Silence Level |
|---|---|
| 7.5-7.4 | 0 |
| 7.39-7.3 | 1 |
| 7.29-7.2 | 2 |
| below 7.2 | 3 |

Vbat = the measured battery voltage.

Once the silence level is determined, the least significant two bits of Timer0 are read. The low battery silence period will then be determined from the following look-up table based on the two bits and the silence level.

Low Battery Silence Period Determination (hours)

| | Silence Level | | | |
|---|---|---|---|---|
| TMR0:0:1 | 0 | 1 | 2 | 3 |
| 0 0 | 9 | 5 | 1 | 0 |
| 0 1 | 10 | 6 | 2 | 0 |
| 1 0 | 11 | 7 | 3 | 0 |
| 1 1 | 12 | 8 | 4 | 0 |

Since it is impossible to know what the least significant two bits of Timer0 will be when the test/silence button 50 is pressed, the silence period will randomly vary from 9 hours to 12 hours at silence level 0. At silence level 1, the silence period will randomly vary from 5 hours to 8 hours. At silence level 2, the silence period will randomly vary from 1 hour to 4 hours, while at silence level 3, the silence period will be 0. At silence level 3, when the battery voltage drops below Vs, for example 7.2 V, the user is not permitted to silence the low battery warning as the battery voltage is at a level at which the user should take immediate steps to replace the battery.

Therefore, the silence period decreases as the battery voltage nears silence level 3. This prevents the low battery warning from being silenced for a period of time that would allow the battery voltage to deplete to a level much below silence level 3.

In addition, in an alternative implementation, during the silence mode, the battery voltage can continue to be monitored to determine whether the voltage reaches Vs. If during the silence mode the voltage reaches Vs, the sound module can exit the silence mode and return to the low battery warning mode, regardless of the amount of time remaining in the silence period.

If desired, a larger or smaller number of silence levels could be used, and the silence levels could be defined using different voltage levels than those described herein. Further, a larger or smaller number of silence periods could be used. In addition, a larger number of bits could be reader from whichever register is used, and any register of the controller that increments or decrements in value could be used in place of Timer0.

Smoke Detector 10

With respect to the smoke detector 10, the low battery silence period is randomly determined based on a reading of the least significant two bits of Timer0 as set forth in the following table.

Low Battery Silence Period Determination (hours)

| TMR0:0:1 | Silence Period |
|---|---|
| 0 0 | 10 |
| 0 1 | 9 |
| 1 0 | 8 |
| 1 1 | 7 |

If desired, the low battery silence period for the detector 10 could also be randomly determined based on the measured battery voltage Vbat and the silence levels as discussed above with respect to the sound module.

In example embodiments, the smoke detector 10 does not have a voltage level, Vs, at which the low battery alarm cannot be silenced. As a result, the user can continue to silence the low battery alarm. An advantage of using a random time period is that the user does not know how long the alarm will be silenced. Therefore, if the user continues to silence the low battery alarm, the likelihood that the silence period will end and the low battery warning will resound at a time of day/night that is inconvenient to the user will increase. Due to this uncertainty, the user is more likely to replace the battery as soon as possible, rather than continue delaying replacement by silencing the low battery warning.

If desired, a larger or smaller number of silence periods could be used. In addition, a larger number of bits could be reader from whichever register is used, and any register of the controller that increments or decrements in value could be used in place of Timer0.

Device Operation

Figure 3:
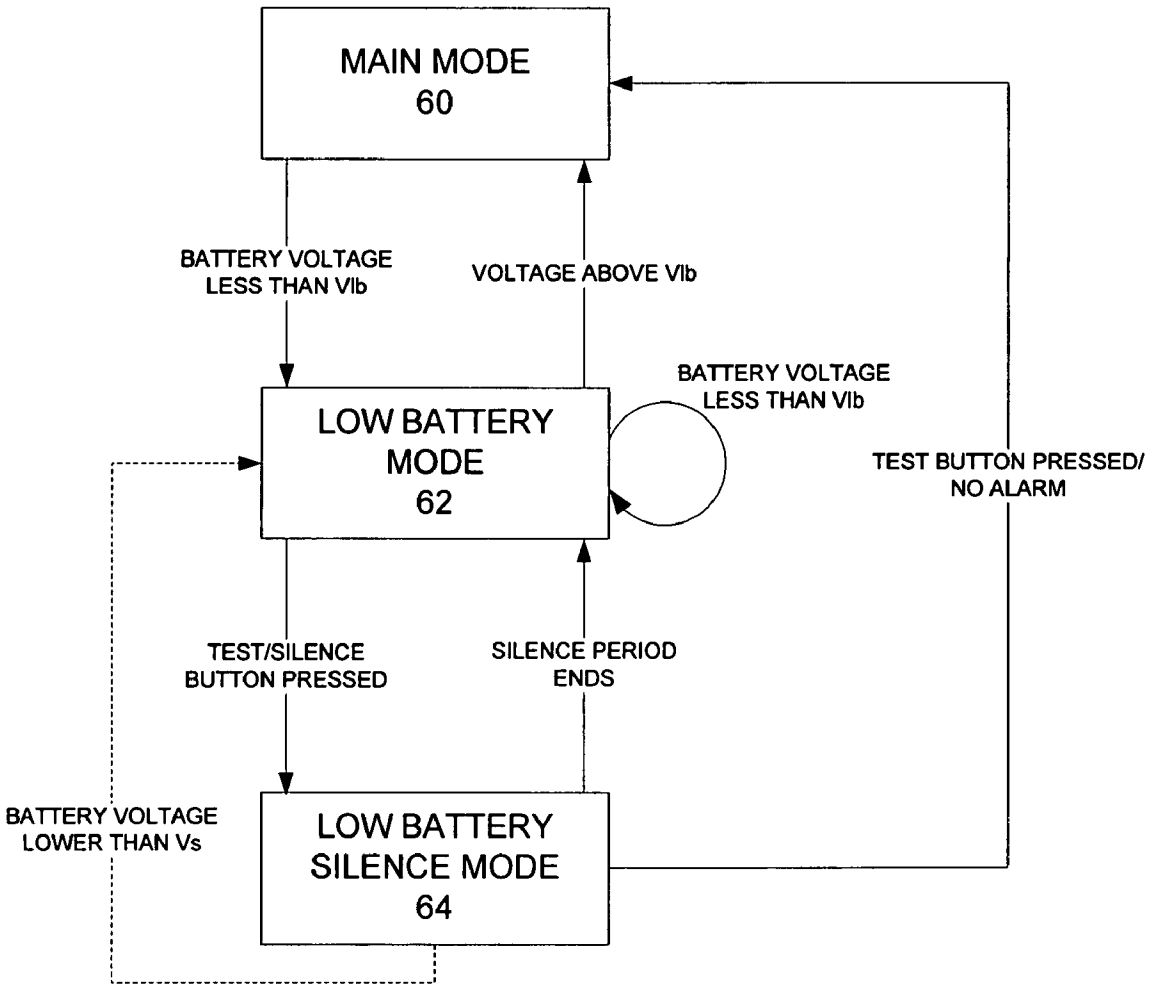
FIG. 3 is a flow chart illustrating example operations of a low battery silencing scheme.

FIG. 3 illustrates the operation of the detector 10. It is to be realized that the sound module 12 operates in a similar manner. Initially, the detector 10 is in a main mode 60, where the detector is not in a low battery condition, the detector has not sensed a hazardous condition and as a result is not in alarm, and the detector 10 is not in a test mode. When the battery monitoring circuit 28 measures that the battery voltage is less than or equal to Vlb, for example Vlb is 7.5 V, the detector enters low battery mode 62, and a low battery warning is issued on alarm circuit 24. The detector 10 continues to monitor the battery voltage and, as long as the voltage is less than Vlb, will remain in low battery mode 62 as long as the test/silence button 30 is not pressed.

If the test/silence button 30 is pressed, the detector will enter a low battery silence mode 64. The detector will remain in silence mode 64 until the silence period ends, at which point it returns to low battery mode 62 and signals a low battery alarm. In one embodiment, if the circuitry measures silence threshold Vs, and the battery voltage reaches or is below Vs, the detector will return to low battery mode 62 as illustrated in dashed lines in FIG. 3. In another embodiment, instead of returning to low battery mode 62, the detector will instead return to main mode 60 if the test/silence button 30 is pressed and the detector has not sensed a hazardous condition.

If the user replaces the battery during the low battery mode 62, the voltage will be measured by the circuit 28 as being above Vlb, and the detector will return to main mode 60. If the battery is replaced during silence mode 64, the detector will remain in silence mode until the end of the silence period, then return to low battery mode 62, and then return to main mode 60 when the voltage is measured by the circuit 28 as being above Vlb.

The silence periods described herein are exemplary. The silence periods can be longer or shorter than those described herein.

What is claimed is:

1. A life safety device, comprising:

a battery monitoring module configured to measure a voltage level of a battery;

an alarm module configured to provide an alarm when the voltage level is less than or equal to a low battery threshold; and a silence module configured to automatically select a random time period and to silence the alarm for the random time period.

2. The device of claim 1, wherein the device includes a battery.

3. The device of claim 2, wherein the device is AC powered, and wherein the battery is used as a backup power source.

4. The device of claim 1, wherein the device is a smoke detector or a carbon monoxide detector.

5. The device of claim 1, wherein the device is a sound module.

6. The device of claim 1, wherein the random time period decreases as the voltage level approaches a silence threshold.

7. A method of monitoring a voltage level of a battery in a life safety device, the method comprising:

periodically measuring the voltage level of the battery;

providing an audible low battery warning when the voltage level of the battery generally equals or is less than a low battery threshold;

automatically selecting a random time period; and silencing the audible low battery warning for the random time period when the voltage level of the battery is determined to be generally equal to or less than the low battery threshold.

8. The method of claim 7, wherein the random time period decreases as the measured voltage level approaches a silence threshold.

9. The method of claim 7, wherein the life safety device is a hazardous condition detector including a battery as a power source.

10. The method of claim 9, wherein the hazardous condition detector is a smoke detector or a carbon monoxide detector.

11. The method of claim 7, wherein the life safety device does not have hazardous condition detection capability, and has a battery as a backup power source.

12. The method of claim 11, wherein the device is a sound module.

13. A method of monitoring a voltage level of a battery in a life safety device, the method comprising:

periodically measuring the voltage level of the battery;

entering a low battery mode when the voltage level of the battery generally equals or is less than a low battery threshold, wherein the low battery mode includes providing an audible low battery warning;

automatically selecting a random time period; and entering the low battery silence mode by silencing the audible low battery warning for the random time period when the voltage level of the battery is determined to generally equal to or less than the low battery threshold.

14. The method of claim 13, comprising returning to the low battery mode when the random time period ends.

15. The method of claim 13, comprising returning to the low battery mode when the measured battery voltage generally equals or is less than a silence threshold.

16. The method of claim 13, wherein the random time period decreases as the voltage level approaches a silence threshold.

17. The method of claim 13, wherein the life safety device is a hazardous condition detector with a battery as a primary power source.

18. The method of claim 17, wherein the hazardous condition detector is a smoke detector or a carbon monoxide detector.

19. The method of claim 13, wherein the life safety device does not have hazardous condition detection capability, and has a battery as a backup power source.

20. The method of claim 13, wherein the device is a sound module.

* * * * *